US006682006B2

(12) United States Patent
Lee

(10) Patent No.: US 6,682,006 B2
(45) Date of Patent: Jan. 27, 2004

(54) SHREDDER WHICH CAN SHRED SMALL MEDIA

(75) Inventor: Pei-Yuan Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 10/063,780

(22) Filed: May 12, 2002

(65) Prior Publication Data

US 2003/0025013 A1 Feb. 6, 2003

(30) Foreign Application Priority Data

Aug. 2, 2001 (TW) ..... 90118936 A

(51) Int. Cl.[7] ..... B02C 25/00
(52) U.S. Cl. ..... 241/36; 241/100; 241/236
(58) Field of Search ..... 241/36, 236, 100

(56) References Cited

U.S. PATENT DOCUMENTS 5,984,215 A 11/1999 Huang
6,308,904 B1 10/2001 Chang
6,550,701 B1 * 4/2003 Chang ..... 241/36

FOREIGN PATENT DOCUMENTS

EP 0 281 136 A2 9/1988

* cited by examiner

*Primary Examiner*—Mark Rosenbaum
(74) *Attorney, Agent, or Firm*—Winston Hsu

(57) ABSTRACT

The present invention provides a shredder, which has a housing, an entry slot on the housing for inserting a desired medium, a shredding device installed inside the housing for shredding the medium, and a central trigger for sensing the medium and therefore triggering the shredding device. The shredding device has a shredding gap between two shredding knives. The central trigger is installed above the central portion of the shredding gap. The shredder further has a side trigger installed between the central portion and an end of the shredding gap. When a large medium is inserted into the entry slot, the medium will trigger the central trigger device and therefore trigger the shredding device. However, when a sufficiently short medium is inserted into the entry slot, the medium is capable of triggering only the side trigger, and therefore triggers the shredding device.

8 Claims, 8 Drawing Sheets

SHREDDER WHICH CAN SHRED SMALL MEDIA

BACKGROUND OF THE INVENTION

1. Field of the Invention

The present invention relates to a shredder. More specifically, the present invention discloses a shredder capable of shredding a little medium.

2. Description of the Prior Art

Figure 1A:
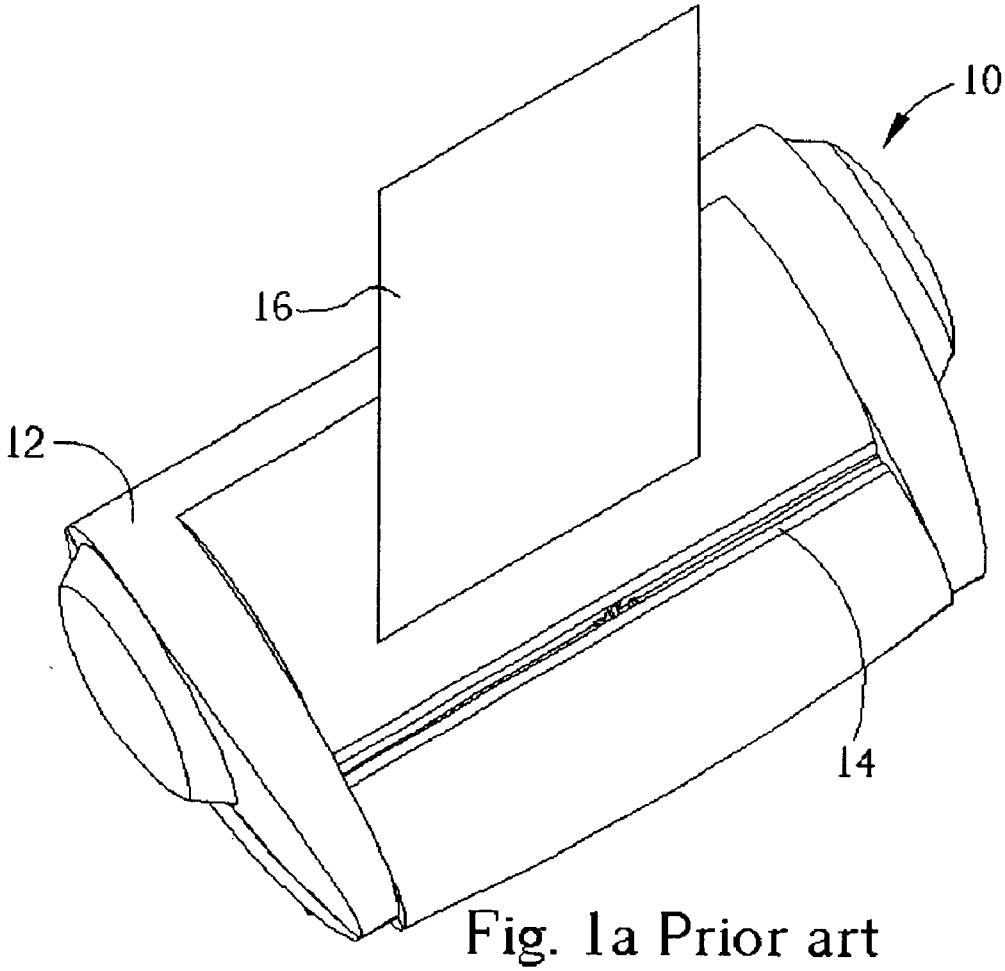
Fig. 1a Prior art
Figure 1B:
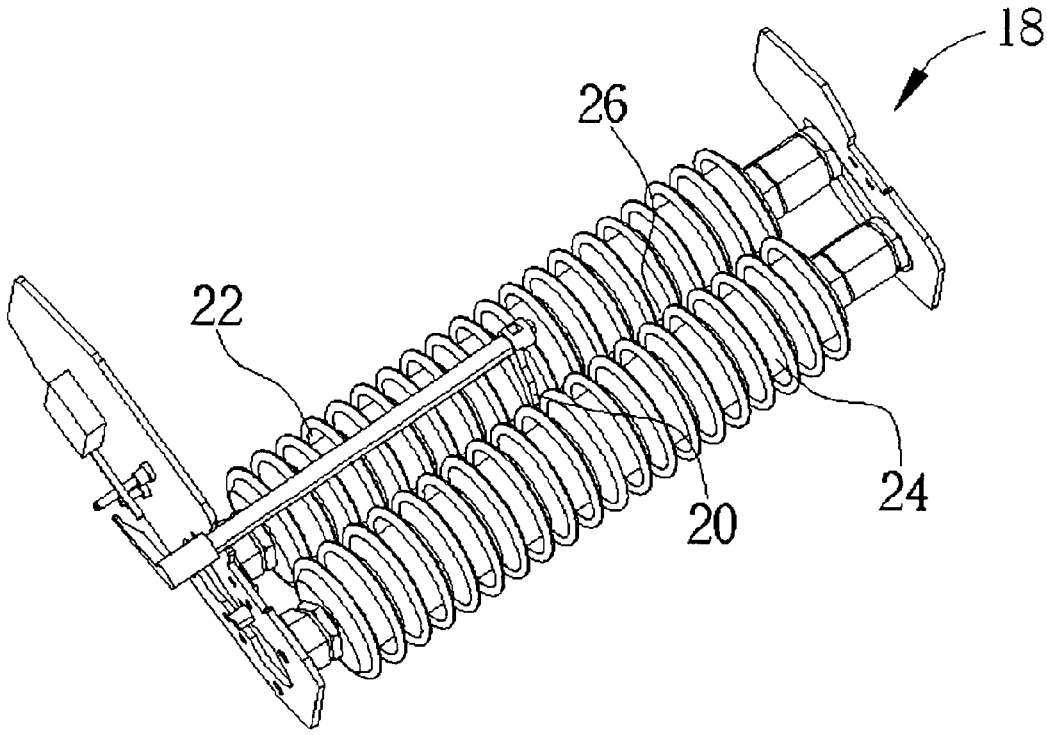
Fig. 1b Prior art

Please refer to FIG. 1*a* and FIG. 1*b*. FIG. 1*a* is a diagram of a prior art shredder 10. FIG. 1*b* is a diagram of a shredding device 18 of the prior art shredder 10. The shredder 10 comprises a housing 12, an entry slot 14 formed on the housing 12 for inserting a shredding paper 16, a shredding device 18 installed inside the housing for shredding the paper 16, and a trigger 20 installed on a central portion of the entry slot 14 for sensing the paper 16 and therefore starting the shredding device 18. As shown in FIG. 1*b*, the shredding device 18 comprises two shredding knives 22, 24, and a shredding gap 26 formed between the two shredding knives. When the paper 16 is inserted into the entry slot 14, the paper 16 will push the trigger 20 so as to start the shredding device 18. Then, the paper 16 will be pushed into the shredding gap 26 and therefore be shredded.

Figure 2:
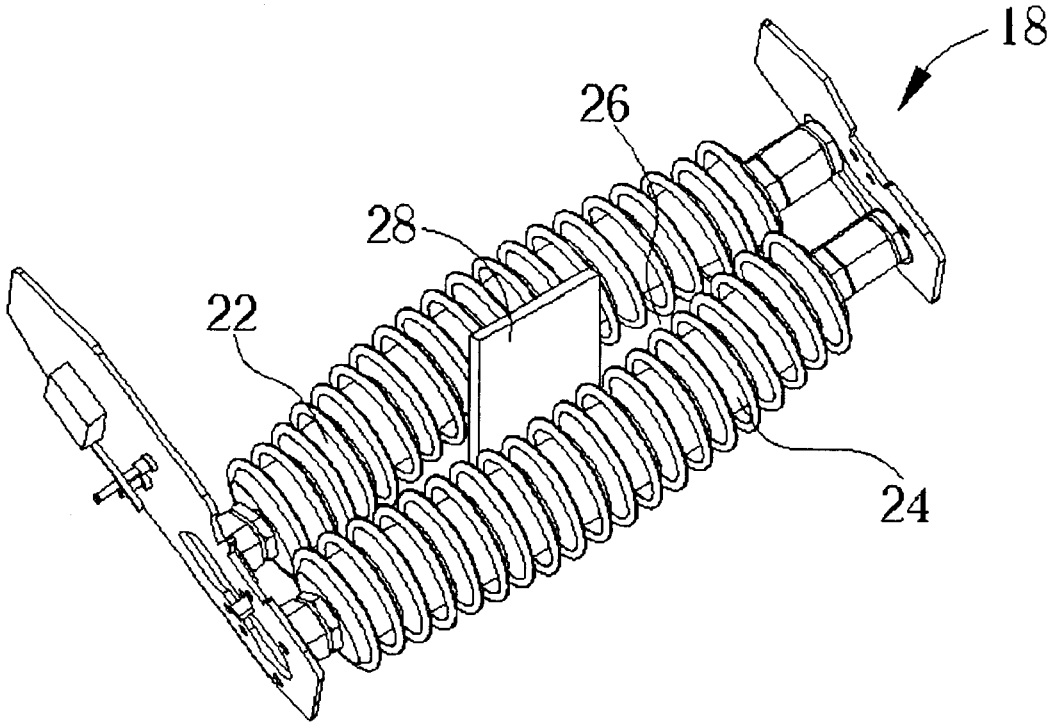
Fig. 2 Prior art

Please refer to FIG. 2. FIG. 2 is a diagram when the shredder 10 of FIG. 1*a* is shredding a little medium. In general, if the shredding medium is a paper as shown in FIG. 1*a*, the shredder 10 is always able to process it appropriately. However, if the shredding medium is a little object such as a credit card or compact disc, problems will arise. As shown in FIG. 2, a credit card 28 is inserted into the shredding gap 26. Because the credit card 28 is thicker and harder than the paper 16, the shredding knives 22, 24 are easily deformed and become curved as shown in FIG. 2. Therefore, after using several times, the shredding knives 22, 24 will be elastically fatigued and be unable to provide enough force to shred items smoothly. When this happens, the shredding device 18 must be changed, which is not convenient.

Because of the problems mentioned above, the traditional shredder is seldom used to shred the little media. There are currently no shredders able to shred little media on the market. However, because of safety and secrecy, a shredder with the function of shredding little media such as credit cards and compact discs has significant value.

SUMMARY OF INVENTION

It is therefore a primary objective of the claimed invention to provide a shredder that is capable of shredding a little medium. The shredder has a side trigger installed in addition to the original trigger, which is installed on the central portion of the shredding gap. The little medium can be inserted into the portion of the shredding gap that is near an end of the shredding gap. Therefore, the shredding device is able to use the portion of the shredder having stronger mechanical strength to shred the little medium, overcoming the limitations of the prior art.

The claimed invention, briefly summarized, discloses a shredder, which comprises a housing, an entry slot on the housing for inserting a desired medium, a shredding device installed inside the housing for shredding the medium, and a central trigger for sensing the medium and therefore triggering the shredding device. The shredding device comprises two shredding knives, and a shredding gap between the two shredding knives. The central trigger is installed above the central portion of the shredding gap. The shredder further comprises a side trigger installed between the central portion and an end of the shredding gap. When a medium with its size longer than half a length of the shredding gap is inserted into the entry slot, the medium will trigger the central trigger device and therefore trigger the shredding device. However, when a medium with its size shorter than half the length of the shredding gap is inserted into the entry slot, the medium is capable of triggering only the side trigger and not the central trigger and therefore triggers the shredding device.

It is an advantage of the claimed invention that the claimed invention comprises a side trigger so that the shredder is able to use the two end portions of the shredding gap to shred the little medium. The mechanical structure of the two end portions of the shredding gap is stronger than the central portion, so that the shredding knives will not be easily deformed and become curvy and will not be elastically fatigued. Therefore, the life of the shredder will be lengthened.

These and other objectives of the present invention will no doubt become obvious to those of ordinary skill in the art after reading the following detailed description of the preferred embodiment which is illustrated in the various figures and drawings.

BRIER DESCRIPTION OF DRAWINGS

FIG. 1*a* is a diagram of a prior art shredder.

FIG. 1*b* is a diagram of a shredding device of the prior art shredder.

FIG. 2 is a diagram when the shredder of FIG. 1 is shredding a little medium.

Figure 3A:
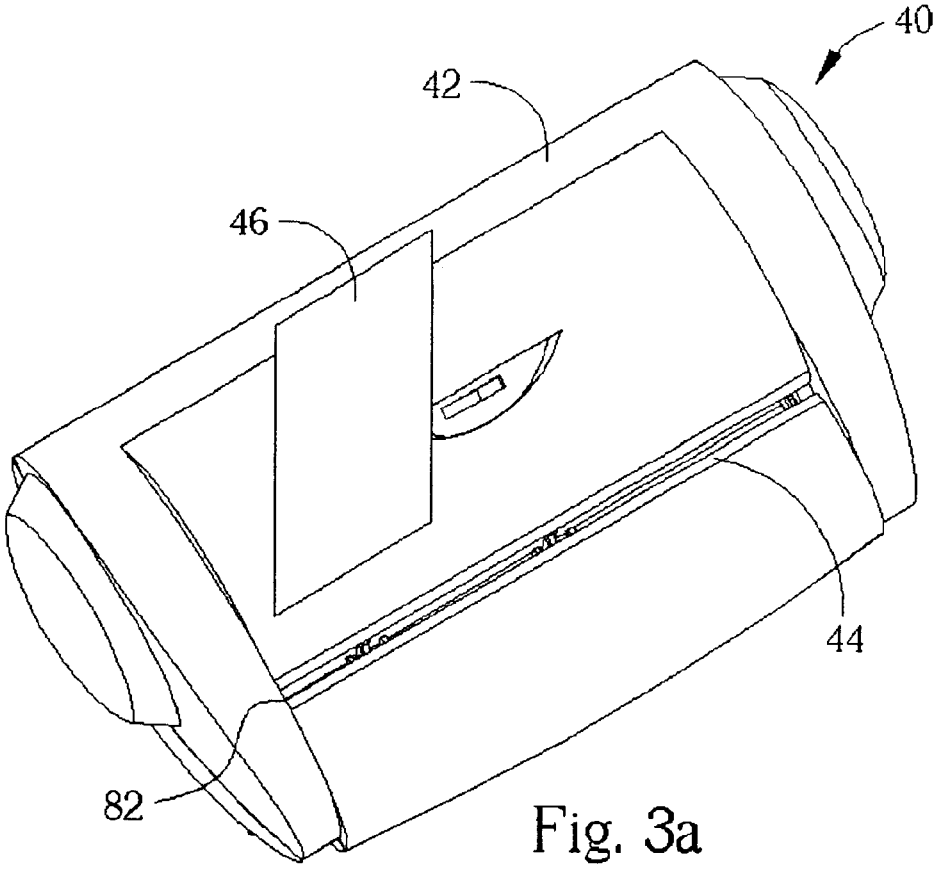

FIG. 3*a* is a diagram of a present invention shredder.

Figure 3B:
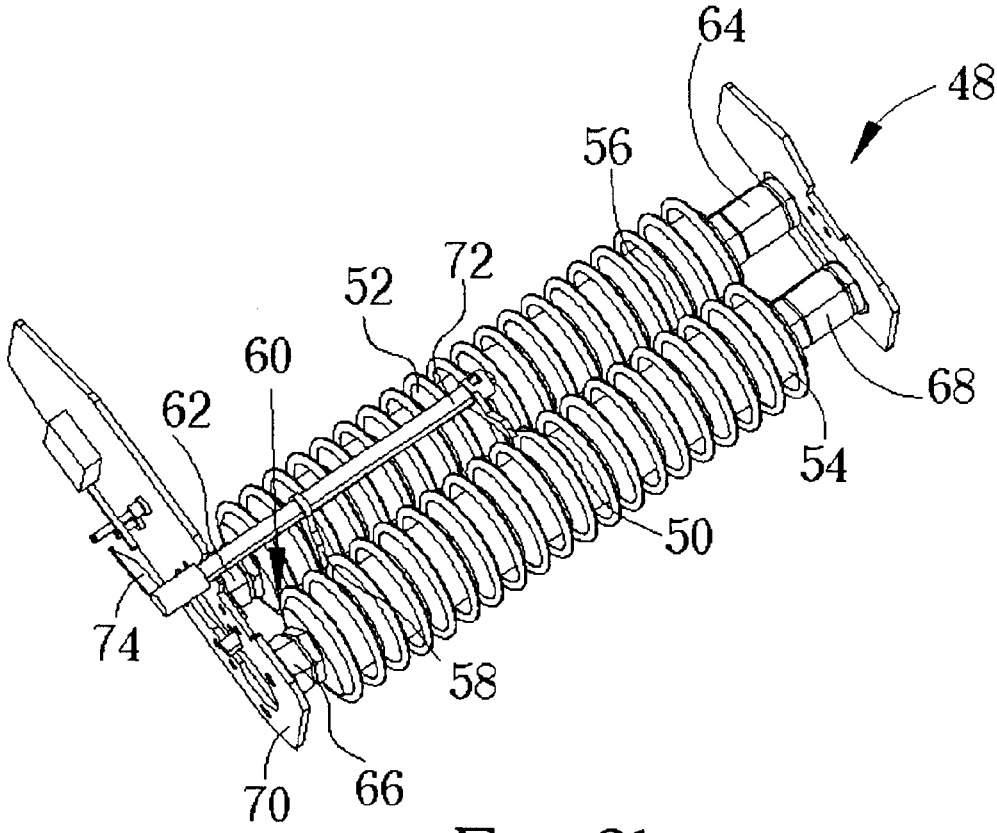

FIG. 3*b* is a diagram of a shredding device of the present invention shredder.

Figure 4A:
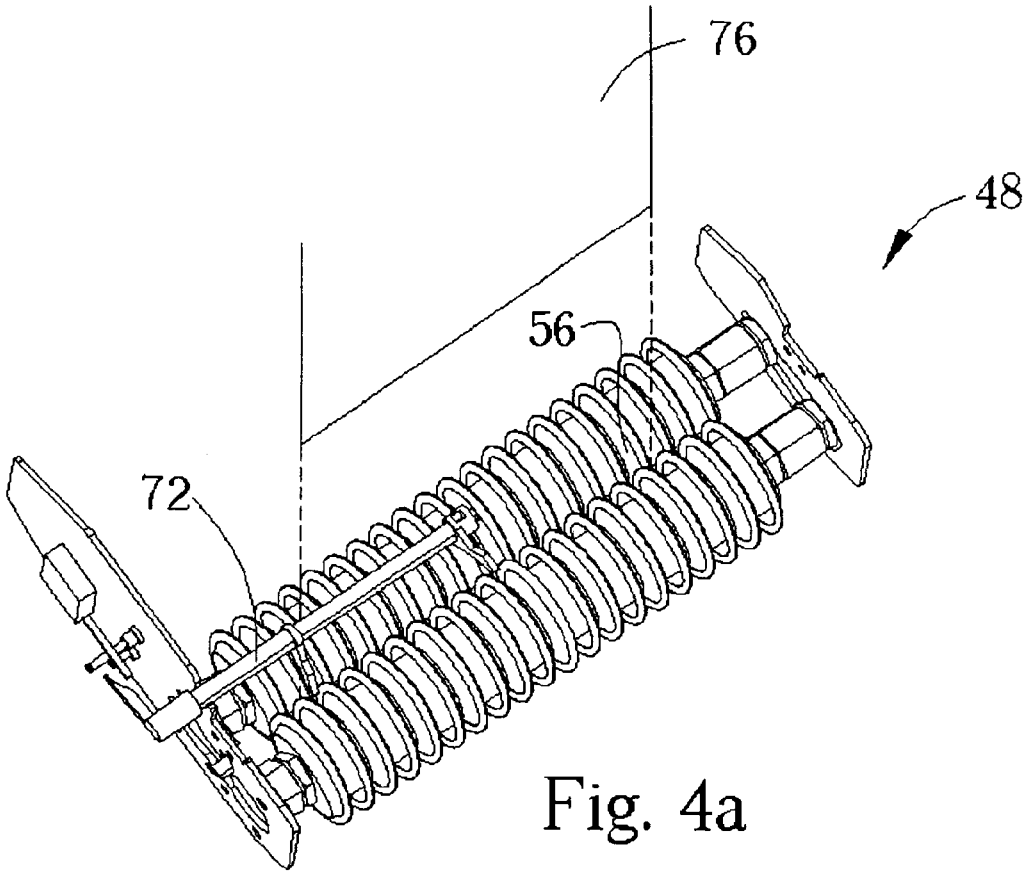

FIG. 4*a* is a diagram of a large medium being inserted into an entry slot.

Figure 4B:
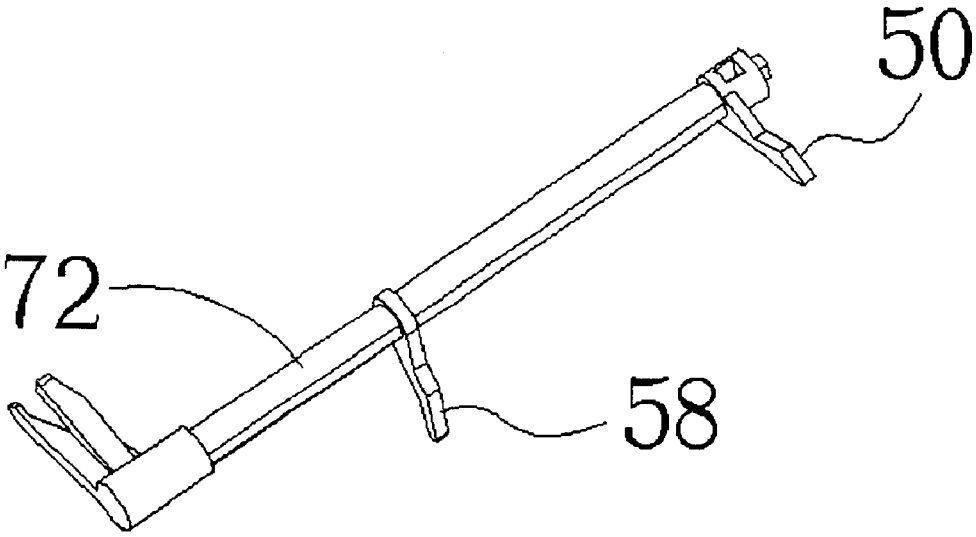

FIG. 4*b* is a diagram of a transmission rod of the present invention shredder.

Figure 5:
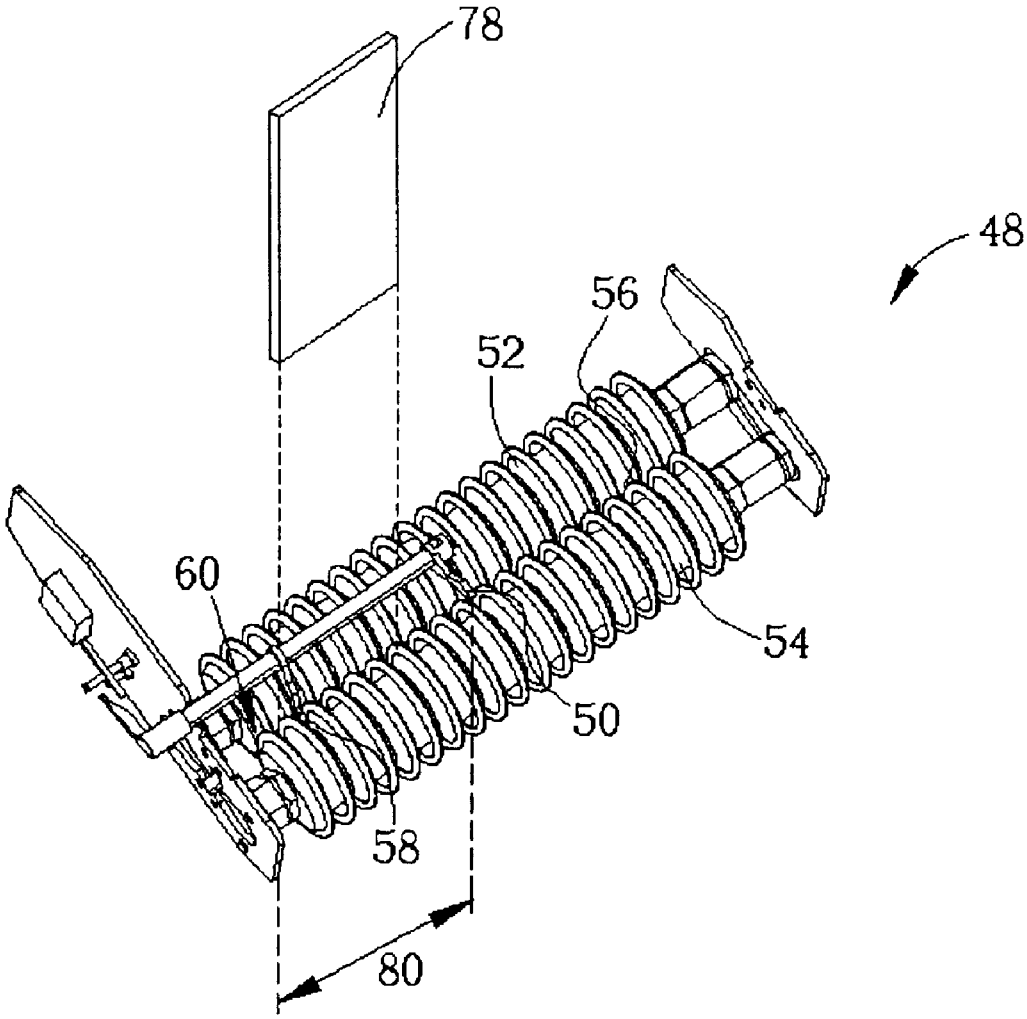

FIG. 5 is a diagram of a little medium being inserted into the entry slot.

DETAILED DESCRIPTION

Please refer to FIG. 3*a* and FIG. 3*b*. FIG. 3*a* is a diagram of a present invention shredder 40. FIG. 3*b* is a diagram of a shredding device 48 of the present invention shredder 40. The shredder 40 comprises a housing 42, a long and narrow entry slot 44 formed on the housing 42 for inserting a shredding medium 46, the shredding device 48 installed inside the housing 42 for shredding the medium 46, and a central trigger 50 for sensing the medium 46 and therefore starting the shredding device 48. As shown in FIG. 3*b*, the shredding device 48 comprises two shredding knives 52, 54, and a shredding gap 56 formed between the two shredding knives 52, 54. The central trigger 50 is installed above the central portion of the shredding gap 56. The shredder 40 further comprises a side trigger 58 installed between the central portion and an end of the shredding gap 56 for sensing a little medium.

As shown in FIG. 3*b*, the shredding knives 52, 54 are two cylinder knives and are parallel to each other. Each shredding knife 52, 54 comprise two ends 62, 64, and 66, 68. The corresponding ends of two shredding knives are fixed to each other. As shown in FIG. 3*b*, the corresponding position of end 62 and end 66 is fixed by the housing 70 of the shredding device 48. Ends 66 and 68 are fixed in the same way. Therefore, the mechanical structure of the two ends of the shredding gap 48 is stronger than the mechanical structure of the central portion.

As shown in FIG. 3*b,* the shredder 40 further comprises a transmission rod 72 installed above the shredding gap 56 and substantially parallel to the shredding gap 56. The central trigger 50 and side trigger 58 are two protrusions on the transmission rod 72. When the central trigger 50 or the side trigger 58 is pushed by inserting the medium 46, the trigger will cause the transmission rod 72 to rotate so as to activate a relay 74, starting the shredding device 48.

Please refer to FIG. 4*a,* FIG. 4*b* and FIG. 5. FIG. 4*a* is a diagram of a large medium 76 being inserted into the shredding gap 56. FIG. 4*b* is a diagram of the transmission rod 72 of the present invention shredder 40. FIG. 5 is a diagram of a little medium 78 being inserted into the shredding gap 56. In the present embodiment, the central trigger 50 and side trigger 58 are configured in a manner such that when a medium with its size longer than half a length of the shredding gap 56 is inserted into the entry slot 44, the medium 76 will first trigger the central trigger 50 to start the shredding device 48. As shown in FIG. 4*b,* because the location of the central trigger 50 is higher than the location of the side trigger 58, when the medium 76 (such as A4 size paper) is inserted into the entry slot 44, the medium 76 will trigger the central trigger 50 first but not the side trigger 58. Avoiding the side trigger 58 prevents the medium 76 from being bent from interference with the side trigger 58. Then, the central trigger 50 will cause the transmission rod 72 to rotate and therefore start the shredding device 48.

As shown in FIG. 5, when a little medium 78 (such as credit card) with its size shorter than half the length of the shredding gap 56 is inserted into the entry slot 44, the little medium 78 will trigger the side trigger 58 but not the central trigger 50 to start the shredding device 48. Then, the little medium 78 will pass through a region 80 between the central portion and the end 60 of the shredding gap 56 as it is shredded. As mentioned before, because the mechanical structure of the two ends of the shredding gap 56 is stronger than the central portion, when the little medium 78 is inserted, the shredding knives 52, 54 will not be easily deformed, and therefore not be elastically fatigued. Moreover, the present invention provides the side trigger 58, therefore, users can insert the little medium 78 near an end 82 of the entry slot 44 as shown in FIG. 3*a,* so as to shred the little medium 78.

The triggers 50, 58 of the embodiments mention above are two protrusions on the transmission rod 72. Actually, the trigger can also be a light sensor or another analogous device. Furthermore, the embodiment of the present invention is not limited to two triggers. Designers are able to increase or decrease the number of triggers according to their needs, so as to achieve the purpose of the present invention.

In contrast to the prior art shredder 10, the present invention comprises the side trigger 58 so that the shredder 40 is able to use the two end portions of the shredding gap 56 to shred the little medium 78. Therefore, without increasing the volume of the shredding knife and not using other material to make the shredding knife, the present invention is able to lengthen the life of the shredder 40.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A shredder comprising:

a housing;

an entry slot formed on the housing for inserting a desired medium;

a shredding device installed in the housing for shredding the medium, the shredding device having two shredding knives and a shredding gap formed between the two shredding knives;

a central trigger installed above a central portion of the shredding gap for sensing the medium and therefore starting the shredding device, and a side trigger installed between the central portion and an end of the shredding gap;

wherein when a medium with its size longer than a length half of the shredding gap is inserted into the entry slot, the medium will trigger the central trigger device to start the shredding device; when a medium with its size shorter than the length half of the shredding gap is inserted into the entry slot, the medium is capable of triggering only the side trigger but not the central trigger to start the shredding device.

2. The shredder of claim 1 wherein the two shredding knives are two cylinder knives and substantially parallel to each other, each shredding knife comprises two ends, and the corresponding ends of the two shredding knives are fixed to each other; when the medium with its size shorter than the length half of the shredding gap is inserted into the entry slot, the medium will trigger the side trigger, pass through a region between the central portion and the end of the shredding gap, and therefore be shredded.

3. The shredder of claim 1 further comprising a transmission rod installed above the shredding gap and substantially parallel to the shredding gap, the central and side triggers are two protrusions on the transmission rod; when one of the central and side triggers is pushed, the transmission rod will be rotated by the pushed trigger so as to start the shredding device.

4. The shredder of claim 1 wherein the central and side triggers are configured in a manner that when the medium with its size longer than a length half of the shredding gap is inserted into the entry slot, the medium will trigger the central trigger device first to start the shredding device.

5. A shredder comprising:

a housing;

an entry slot formed on the housing for inserting a desired medium;

a shredding device installed in the housing for shredding the medium, the shredding device having two shredding knives and a shredding gap formed between the two shredding knives;

a side trigger installed above the shredding gap, wherein a length between the side trigger and an end of the shredding gap is shorter than a length half of the shredding gap; and a central trigger installed above a central portion of the shredding gap, and the central and side triggers are configured in a manner that when the medium with its size longer than a length half of the shredding gap is inserted into the entry slot, the medium will trigger the central trigger device to start the shredding device;

wherein when a medium with its size shorter than the length half of the shredding gap is inserted into the entry slot, the medium will trigger the side trigger to start the shredding device, pass through a region between a central portion and the end of the shredding gap, and therefore be shredded.

6. The shredder of claim 5 wherein the two shredding knives are two cylinder knives and substantially parallel to each other, each shredding knife comprises two ends, and the corresponding ends of the two shredding knives are fixed to each other.

7. The shredder of claim 5 further comprising a transmission rod installed above the shredding gap and substantially parallel to the shredding gap, the central and the side triggers are two protrusions on the transmission rod; when either the central or the side trigger is pushed, the transmission rod will be rotated by the pushed trigger so as to start the shredding device.

8. The shredder of claim 5 wherein the side trigger is an optical sensor.

* * * * *